US009482489B2

(12) United States Patent
Peters et al.

(10) Patent No.: US 9,482,489 B2
(45) Date of Patent: Nov. 1, 2016

(54) RANGING METHODS FOR INCLINED SHOOTING OF PROJECTILE WEAPON

(71) Applicant: Leupold & Stevens, Inc., Beaverton, OR (US)

(72) Inventors: Victoria J. Peters, Vernonia, OR (US); Tim Lesser, Forest Grove, OR (US); Andrew W. York, Portland, OR (US); Rick R. Regan, Aloha, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 14/629,309

(22) Filed: Feb. 23, 2015

(65) Prior Publication Data

US 2016/0178321 A1 Jun. 23, 2016

Related U.S. Application Data

(60) Continuation of application No. 13/902,905, filed on May 27, 2013, now Pat. No. 8,959,823, which is a division of application No. 13/287,034, filed on Nov. 1, 2011, now Pat. No. 8,448,372, which is a (Continued)

(51) Int. Cl.
*F41G 1/473* (2006.01)
*F41G 3/02* (2006.01)
(Continued)

(52) U.S. Cl.
CPC ..... *F41G 3/02* (2013.01); *F41G 1/473* (2013.01); *F41G 3/06* (2013.01); *F41G 3/08* (2013.01)

(58) Field of Classification Search
CPC ..... F41G 3/06; F41G 3/02; F41G 3/08; F41G 1/473; F41G 1/38
USPC ..... 42/111, 114, 130, 142; 356/399; 359/4.01, 11, 141.1; 235/400–418
See application file for complete search history.

(56) References Cited

U.S. PATENT DOCUMENTS 3,464,770 A 9/1969 Schmidt
3,563,151 A 2/1971 Koeber
(Continued)

FOREIGN PATENT DOCUMENTS

DE 199 49 800 A1 4/2001
GB 2 225 844 A 6/1990
(Continued)

OTHER PUBLICATIONS

Mike Brown, "The Rifleman's Rule—Revisited", May 2003, 9 pages.
(Continued)

*Primary Examiner* — Michael David
(74) *Attorney, Agent, or Firm* — Stoel Rives LLP

(57) ABSTRACT

A method for shooting a projectile weapon involves determining the inclination of a line of sight from a vantage point to a target and a line-of-sight range to the target, then predicting a trajectory parameter at the line-of-sight range, for a preselected projectile. Using the trajectory parameter, an equivalent horizontal range may then be determined, wherein the equivalent horizontal range is the range at which the trajectory parameter would be expected to occur if the projectile were shot from the vantage point toward a theoretical target located in a horizontal plane intersecting the vantage point. The equivalent horizontal range may be utilized to compensate for ballistic drop when shooting the projectile weapon. The method may be embodied in a handheld laser rangefinder including a memory for storing ballistic data. Systems for automatic hold over adjustment in a weapon aiming device are also disclosed.

26 Claims, 10 Drawing Sheets

Related U.S. Application Data continuation of application No. 12/697,203, filed on Jan. 29, 2010, now Pat. No. 8,046,951, which is a division of application No. 12/144,402, filed on Jun. 23, 2008, now Pat. No. 7,690,145, which is a division of application No. 11/555,591, filed on Nov. 1, 2006, now Pat. No. 7,654,029.

(60) Provisional application No. 60/732,773, filed on Nov. 1, 2005.

(51) Int. Cl.
*F41G 3/06* (2006.01)
*F41G 3/08* (2006.01)

(56) References Cited

U.S. PATENT DOCUMENTS 3,584,559 A 6/1971 Levin
3,639,997 A 2/1972 Koeber
3,644,043 A 2/1972 Jones et al.
3,679,307 A 7/1972 Zoot et al.
3,688,408 A 9/1972 Smith et al.
3,690,767 A 9/1972 Missio et al.
3,737,232 A 6/1973 Milburn, Jr.
3,754,828 A 8/1973 Darvasi
3,781,111 A 12/1973 Fletcher et al.
3,797,909 A 3/1974 Hadzimahalis
3,839,725 A 10/1974 Koppensteiner
3,845,276 A 10/1974 Kendy et al.
3,845,474 A 10/1974 Lange et al.
3,847,474 A 11/1974 Uterhart
3,895,871 A 7/1975 Strasser
3,897,150 A 7/1975 Bridges et al.
3,899,251 A 8/1975 Frenk et al.
3,948,587 A 4/1976 Rubbert
3,982,246 A 9/1976 Lubar
3,990,155 A 11/1976 Akin, Jr. et al.
3,992,615 A 11/1976 Bennett et al.
4,025,193 A 5/1977 Pond et al.
4,136,394 A 1/1979 Jones et al.
4,173,402 A 11/1979 Horike et al.
4,195,425 A 4/1980 Leitz et al.
4,266,463 A 5/1981 Saltin
4,268,167 A 5/1981 Alderman
4,305,657 A 12/1981 Masunaga et al.
4,321,683 A 3/1982 Goring et al.
4,325,190 A 4/1982 Duerst
4,329,033 A 5/1982 Masunaga et al.
4,355,904 A 10/1982 Balasubramanian
4,457,621 A 7/1984 Harris et al.
4,531,052 A 7/1985 Moore
4,561,204 A 12/1985 Binion
4,593,967 A 6/1986 Haugen
4,617,741 A 10/1986 Bordeaux et al.
4,665,795 A 5/1987 Carbonneau et al.
4,681,433 A 7/1987 Aeschlimann
4,760,770 A 8/1988 Bagnall-Wild et al.
4,777,352 A 10/1988 Moore
4,787,739 A 11/1988 Gregory
4,834,531 A 5/1989 Ward
4,949,089 A 8/1990 Ruszkowski, Jr.
4,965,439 A 10/1990 Moore
4,988,189 A 1/1991 Kroupa et al.
4,993,833 A 2/1991 Lorey et al.
5,022,751 A 6/1991 Howard
5,026,158 A 6/1991 Golubic
5,082,362 A 1/1992 Schneiter
5,216,815 A 6/1993 Bessacini
5,233,357 A 8/1993 Ingensand et al.
5,241,360 A 8/1993 Key et al.
5,262,838 A 11/1993 Tocher
5,291,262 A 3/1994 Dunne
5,294,110 A 3/1994 Jenkins et al.
5,311,271 A 5/1994 Hurt et al.
5,313,409 A 5/1994 Wiklund et al.
5,359,404 A 10/1994 Dunne
5,374,985 A 12/1994 Beadles et al.
5,374,986 A 12/1994 Solinsky
5,375,072 A 12/1994 Cohen
5,479,712 A 1/1996 Hargrove et al.
5,483,336 A 1/1996 Tocher
5,519,642 A 5/1996 Kishimoto
5,539,513 A 7/1996 Dunne
5,568,152 A 10/1996 Janky et al.
5,586,063 A 12/1996 Hardin et al.
5,589,928 A 12/1996 Babbitt et al.
5,634,278 A 6/1997 London
5,638,163 A 6/1997 Nourrcier, Jr.
5,650,949 A 7/1997 Kishimoto
5,669,174 A 9/1997 Teetzel
5,677,760 A 10/1997 Mikami et al.
5,686,690 A 11/1997 Lougheed et al.
5,691,808 A 11/1997 Nourrcier et al.
5,751,406 A 5/1998 Nakazawa et al.
5,771,623 A 6/1998 Pernstich et al.
5,806,020 A 9/1998 Zykan
5,812,893 A 9/1998 Nikita et al.
5,824,942 A 10/1998 Mladjan et al.
5,914,775 A 6/1999 Hargrove et al.
5,933,224 A 8/1999 Hines et al.
5,940,171 A 8/1999 Tocher
6,023,322 A 2/2000 Bamberger
6,034,764 A 3/2000 Carter
6,073,352 A 6/2000 Zykan et al.
6,131,294 A 10/2000 Jibiki
6,252,706 B1 6/2001 Kaladgew
6,269,581 B1 8/2001 Groh
6,407,817 B1 6/2002 Norita et al.
6,516,699 B2 2/2003 Sammut et al.
6,583,862 B1 6/2003 Perger
6,591,537 B2 7/2003 Smith
6,634,112 B2 10/2003 Carr et al.
6,824,942 B2 11/2004 Silence et al.
6,873,406 B1 3/2005 Hines et al.
6,886,287 B1 5/2005 Bell et al.
7,118,498 B2 10/2006 Meadows et al.
7,194,838 B2 3/2007 Smith, III
7,239,377 B2 7/2007 Vermillion et al.
7,603,804 B2 10/2009 Zaderey et al.
7,654,029 B2 2/2010 Peters et al.
7,658,031 B2 2/2010 Cross et al.
7,690,145 B2 4/2010 Peters et al.
7,703,679 B1 4/2010 Bennets et al.
8,001,714 B2 8/2011 Davison
8,046,951 B2 11/2011 Peters et al.
8,172,139 B1 5/2012 McDonald et al.
8,314,923 B2 11/2012 York et al.
8,448,372 B2 5/2013 Peters et al.
8,733,647 B2 5/2014 Roider et al.
8,959,823 B2 2/2015 Peters et al.
2002/0107768 A1 8/2002 Davis et al.
2003/0101604 A1 6/2003 McGivern
2003/0145719 A1 8/2003 Friedli et al.
2004/0020099 A1 2/2004 Osborn
2004/0231220 A1 11/2004 McCormick
2005/0021282 A1 1/2005 Sammut et al.
2005/0046706 A1 3/2005 Sesek et al.
2005/0198885 A1 9/2005 Staley
2005/0219690 A1 10/2005 Lin et al.
2005/0221905 A1 10/2005 Dunne et al.
2005/0229468 A1 10/2005 Zaderey et al.
2005/0246910 A1 11/2005 Mowers
2005/0252064 A1 11/2005 Williamson, IV et al.
2005/0268521 A1 12/2005 Cox et al.
2006/0010760 A1 1/2006 Perkins et al.
2006/0010762 A1 1/2006 Lin et al.
2006/0077375 A1 4/2006 Vermillion et al.
2006/0225335 A1 10/2006 Florence et al.
2007/0044364 A1 3/2007 Sammut et al.
2007/0068018 A1 3/2007 Gilmore
2007/0097351 A1 5/2007 York et al.
2007/0137088 A1 6/2007 Peters et al.
2007/0137090 A1 6/2007 Conescu

(56) References Cited

U.S. PATENT DOCUMENTS

| | | | |
|---|---|---|---|
| 2007/0137091 | A1 | 6/2007 | Cross et al. |
| 2008/0098640 | A1 | 5/2008 | Sammut et al. |
| 2009/0199702 | A1 | 8/2009 | Zaderey et al. |
| 2009/0200376 | A1 | 8/2009 | Peters et al. |
| 2010/0282845 | A1 | 11/2010 | Peters et al. |
| 2011/0021293 | A1 | 1/2011 | York et al. |
| 2012/0124884 | A1 | 5/2012 | McDonald et al. |
| 2012/0217300 | A1 | 8/2012 | McDonald et al. |
| 2012/0246992 | A1 | 10/2012 | Peters et al. |
| 2012/0298749 | A1 | 11/2012 | Roider et al. |
| 2015/0013206 | A1 | 1/2015 | Peters et al. |

FOREIGN PATENT DOCUMENTS

| | | | |
|---|---|---|---|
| JP | 10300840 | A | 11/1998 |
| JP | 2000356500 | A | 12/2000 |
| JP | 2001021291 | A | 1/2001 |
| TW | 383362 | B | 3/2000 |
| WO | WO 93/20399 | | 10/1993 |
| WO | WO 2005/015285 | A2 | 2/2005 |
| WO | WO 2006/060489 | | 6/2006 |

OTHER PUBLICATIONS

Leica, Leica Vector Rangefinding Binoculars, http://www.leica.com/optronics/product/vector.html, archived Jun. 7, 1997.

PCT/US06/60458 Written Opinion of the International Searching Authority, mailed Aug. 25, 2008.

PCT/US06/60458 International Search Report, mailed Aug. 25, 2008.

PCT/US06/60458 International Preliminary Report on Patentability, mailed Oct. 9, 2008.

Bushnell Performance Optics, Pinseeker 1500 Laser Rangefinder, www.bushnell.com/products/rangefinder/specs/20/5103.cfm, visited Nov. 4, 2005, 1 p.

Bushnell Performance Optics, Laser Rangefinder Tech Talk, www.bushnell.com/products/tech_talk/rangefinders.cfm, visited Nov. 4, 2005, 2 pp.

Gun accessories.com, Swarovski Laser Ranging Scope, www.gunaccessories.com/Swarovski/LaserRangefindingScope/index.asp, visited Oct. 31, 2006, 1 p.

McDonald, William T., "Inclined Fire," available at www.exteriorballistics.com/ebexplained/article1.html, Jun. 2003, 9 pp.

Sierra Bullets, "Infinity Exterior Ballistic Software," www.sierrabullets.com, visited Oct. 26, 2005, 2 pp.

Sundra, Jon, "High-Tech Optics Feed Customers' Desire for Gizmos-Riflescopes and Binoculars," *Shooting Industry Magazine*, archived at www.findarticles.com, Jun. 1999, 2 pp.

Sundra, Jon R., "A Grand Range Finder-Brief Article," *Guns Magazine*, archived at www.findarticles.com, Jun. 1999, 1 p.

USPTO, Office Action dated Mar. 29, 2010, U.S. Appl. No. 12/163,333, 6 pages.

Office Action Response dated Aug. 27, 2010, U.S. Appl. No. 12/163,333, 9 pages.

USPTO, Office Action dated Nov. 24, 2010, U.S. Appl. No. 12/163,333, 7 pages.

RANGING METHODS FOR INCLINED SHOOTING OF PROJECTILE WEAPON

RELATED APPLICATION

This application is a divisional under 35 USC §121 of and claims priority under 35 USC §120 of U.S. patent application Ser. No. 13/902,905, filed May 27, 2103 (now U.S. Pat. No. 8,959,823), which is a divisional of U.S. patent application Ser. No. 13/287,034, filed Nov. 1, 2011 (now U.S. Pat. No. 8,448,372), which is a continuation of U.S. patent application Ser. No. 12/697,203, filed Jan. 29, 2010 (now U.S. Pat. No. 8,046,951), which is a divisional of U.S. patent application Ser. No. 12/144,402, filed Jun. 23, 2008 (now U.S. Pat. No. 7,690,145), which is a divisional of U.S. patent application Ser. No. 11/555,591, filed Nov. 1, 2006 (now U.S. Pat. No. 7,654,029), which claims the benefit under 35 U.S.C. §119(e) from U.S. Provisional Patent Application No. 60/732,773, filed Nov. 1, 2005, all of which are incorporated herein by reference.

TECHNICAL FIELD

The field of this disclosure relates to methods and systems for compensating for ballistic drop and to rangefinders implementing such methods.

BACKGROUND

Exterior ballistic software is widely known and used for accurately predicting the trajectory of a bullet, including ballistic drop and other ballistic phenomena. Popular software titles include Infinity 5™, published by Sierra Bullets, and PRODAS™, published by Arrow Tech Associates, Inc. Many other ballistics software programs also exist. Ballistics software may include a library of ballistic coefficients and typical muzzle velocities for a variety of particular cartridges, from which a user can select as inputs to ballistic calculations performed by the software. Ballistics software typically also allows a user to input firing conditions, such as the angle of inclination of a line of sight to a target, range to the target, and environmental conditions, including meteorological conditions. Based on user input, ballistics software may then calculate bullet drop, bullet path, or some other trajectory parameter. Some such software can also calculate a recommended aiming adjustment that would need to be made in order to hit the target. Aiming adjustments may include holdover and holdunder adjustments (also referred to as come-up and come-down adjustments), designated in inches or centimeters at the observed range. Another way to designate aiming adjustment is in terms of elevation adjustment to a riflescope or other aiming device (relative to the weapon on which the aiming device is mounted), typically expressed in minutes of angle (MOA). Most riflescopes include adjustment knob mechanisms that facilitate elevation adjustments in ¼ MOA or ½ MOA increments.

For hunters, military snipers, SWAT teams, and others, it is impractical to carry a personal computer, such as a laptop computer, for running ballistics software. Consequently, some shooters use printed ballistics tables to estimate the amount of elevation adjustment necessary. However, ballistics tables also have significant limitations. They are typically only available for level-fire scenarios in ideal conditions or for a very limited range of conditions and, therefore, do not provide an easy way to determine the appropriate adjustments for aiming at inclined targets, which are elevated or depressed relative to the shooter.

Methods have been devised for using level-fire ballistics tables in the field to calculate an estimated elevation adjustment necessary for inclined shooting. The most well known of these methods is the so-called "rifleman's rule," which states that bullet drop or bullet path at an inclined range can be estimated as the bullet path or bullet drop at the corresponding horizontal range to the elevated target (i.e., the inclined range times the cosine of the angle of inclination). However, the rifleman's rule is not highly accurate for all shooting conditions. The rifleman's rule and other methods for estimating elevation adjustment for inclined shooting are described in the paper by William T. McDonald titled "Incline Fire" (June 2003).

Some ballistic software programs have been adapted to operate on a handheld computer. For example, U.S. Pat. No. 6,516,699 of Sammut et al. describes a personal digital assistant (PDA) running an external ballistics software program. Numerous user inputs of various kinds are required to obtain useful calculations from the software of Sammut et al. '699. When utilizing ballistic compensation parameters calculated by the PDA, such as holdover or come-up, a shooter may need to adjust an elevation setting by manually manipulating an elevation adjustment knob of the riflescope. Alternatively, the user may need to be skilled at holdover compensation using a riflescope with a special reticle described by Sammut et al. '669. Such adjustments may be time consuming and prone to human error. For hunters, the delay involved in making such adjustments can mean the difference between making a shot and missing an opportunity to shoot a game animal.

The present inventors have identified a need for improved methods and systems for ballistic compensation that are particularly useful for inclined shooting and which would also be useful for archers.

DETAILED DESCRIPTION OF PREFERRED EMBODIMENTS

Figure 1:
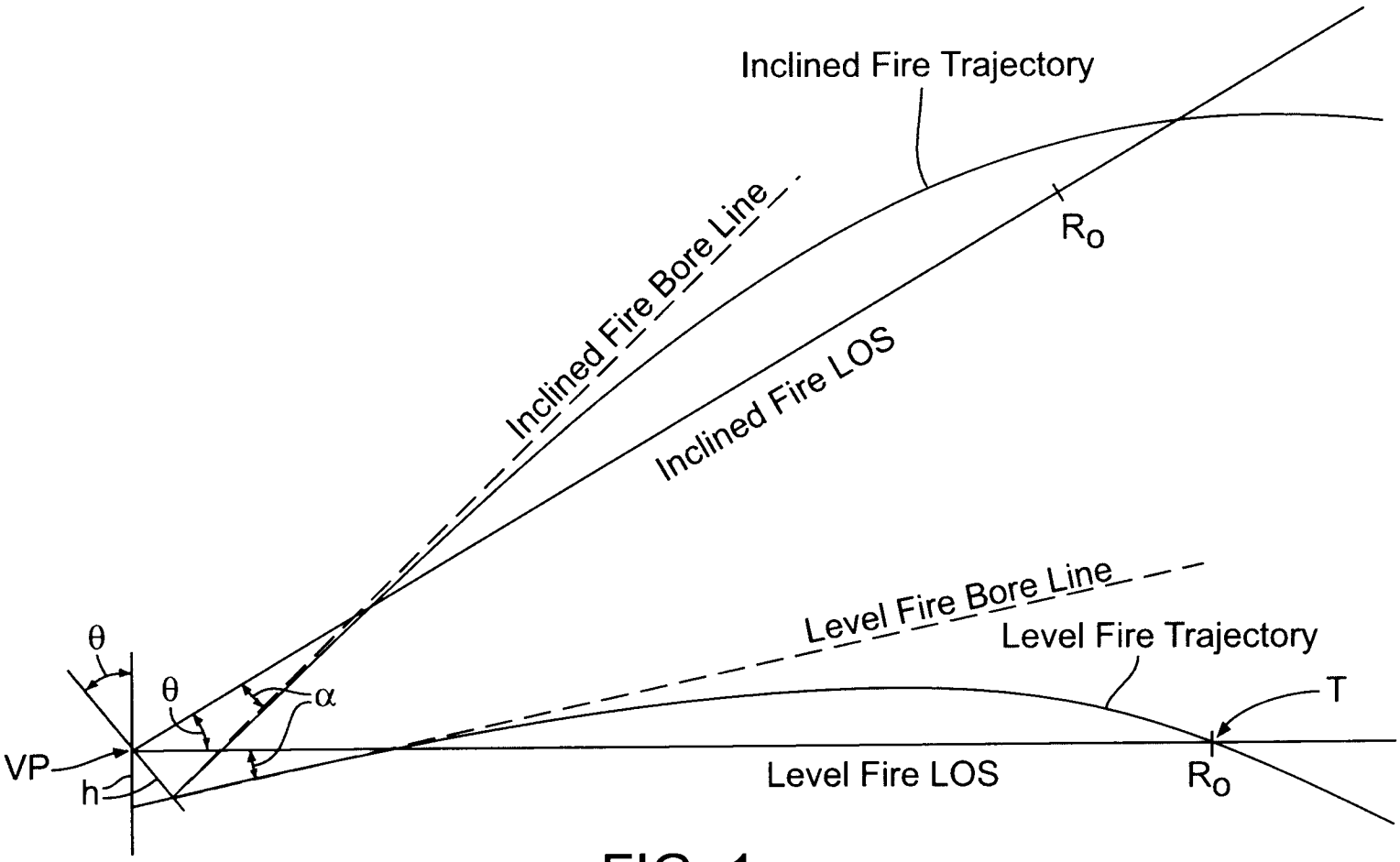
FIG. 1 is a schematic diagram illustrating level-fire and inclined-fire trajectories for a projectile.

FIG. 1 is a schematic diagram illustrating the effect on a projectile's trajectory of the inclination of the line along which projectile is fired, cast, or otherwise shot (the "line of initial trajectory" or, in the case of guns, the "bore line"). For purposes of illustration, the trajectory curves and angles between various lines in FIG. 1 are greatly exaggerated and not to scale.

With reference to FIG. 1, a "level fire" trajectory is the path along which a projectile moves when shot at a target T at range $R_0$ and at substantially the same geographic elevation as a vantage point VP of the shooter. The projectile weapon has a line of initial trajectory ("level fire bore line") that is not actually level, but rather is inclined relative to the level fire line of sight (level fire LOS) by an elevation angle $\alpha$. The level fire line of sight, which is approximately horizontal, begins at a height h above the beginning of the bore line. The height h and elevation angle $\alpha$ represent the typical mounting arrangement of a riflescope on a firearm or an archery sight on a bow. The level fire trajectory intersects the level fire line of sight at range $R_0$ which is known as the "sighted-in range" or "zero range" or "zeroed-in range" of the weapon and sight combination. The sighted-in range $R_0$ is typically established by shooting the weapon at a target at a known horizontal reference distance, such as 100 yards, and adjusting the elevation angle $\alpha$ of the riflescope or other sighting device until projectiles shot by the weapon impact the target at a point that coincides with the cross hairs or other aiming mark of the riflescope or other sighting device.

An "inclined fire trajectory" is also depicted in FIG. 1. The inclined fire trajectory represents the path along which the same projectile travels when aimed at a target that is elevated relative to vantage point VP. The height h and elevation angle $\alpha$ of the inclined fire line of sight relative to the bore line are the same as in the level-fire scenario. However, the inclined fire line of sight is inclined by angle of inclination $\theta$. As illustrated in FIG. 1, the inclined fire trajectory crosses the inclined fire line of sight at a distance substantially greater than the sighted-in range $R_0$. This overshoot is due to the effect of gravity, which always acts in the vertically downward direction, regardless of the angle of inclination $\theta$. The overshoot phenomena and prior methods of correcting for it are discussed in detail by William T. McDonald in his paper titled "Inclined Fire" (June 2003). The present inventors have observed that effects of inclination are typically even more pronounced in archery than for bullets, due to differences in the initial speed and aerodynamic characteristics of the projectiles used.

In accordance with embodiments described herein, it has been recognized that many hunters (including bow hunters) and other shooters, such as military law enforcement snipers, are versed in holdover techniques for compensating for ballistic drop in horizontal fire scenarios. A holdover adjustment involves aiming high by a measured or estimated amount. For example, a hunter shooting a deer rifle with a riflescope sighted in at 200 yards may know that a kill-shot for a deer (in the deer's heart) at a level-fire range of approximately 375 yards involves aiming the riflescope's cross hairs at the top of the deer's shoulders. Holdover adjustments are much faster in practice than elevation adjustments, which involve manually adjusting an elevation setting of the riflescope or other aiming device to change the elevation angle $\alpha$ of the aiming device relative to the weapon. They are also the primary mode of aiming adjustment for most archers. Holdover and holdunder techniques also avoid the need to re-zero the aiming device after making a temporary elevation adjustment.

Many varieties of ballistic reticles are employed in riflescopes to facilitate holdover and holdunder. For archery, a common ballistic aiming sight known as a pin sight is often employed for holdover aiming adjustment. Ballistic reticles and other ballistic aiming sights generally include multiple aiming marks spaced apart along a vertical axis. Exemplary ballistic reticles include mil-dot reticles and variations, such as the LEUPOLD TACTICAL MILLING RETICLE™ (TMR™) sold by Leupold & Stevens, Inc., the assignee of the present application; Leupold® DUPLEX™ reticles; the LEUPOLD SPECIAL PURPOSE RETICLE™ (SPR™); and LEUPOLD BALLISTIC AIMING SYSTEM™ (BAS™) reticles, such as the LEUPOLD BOONE & CROCKETT BIG GAME RETICLE™ and the LEUPOLD VARMINT HUNTER'S RETICLE™. BAS reticles and methods of using them are described in U.S. patent application Ser. No. 10/933,856, filed Sep. 3, 2004, titled "Ballistic Reticle for Projectile Weapon Aiming Systems and Method of Aiming" ("the '856 application"), which is incorporated herein by reference. As described in the '856 application, BAS reticles include secondary aiming marks that are spaced at progressively increasing distances below a primary aiming mark and positioned to compensate for ballistic drop at preselected regular incremental ranges for a group of ammunition having similar ballistic characteristics.

Equivalent Horizontal Range and Inclined Shooting Methods

Figure 2:
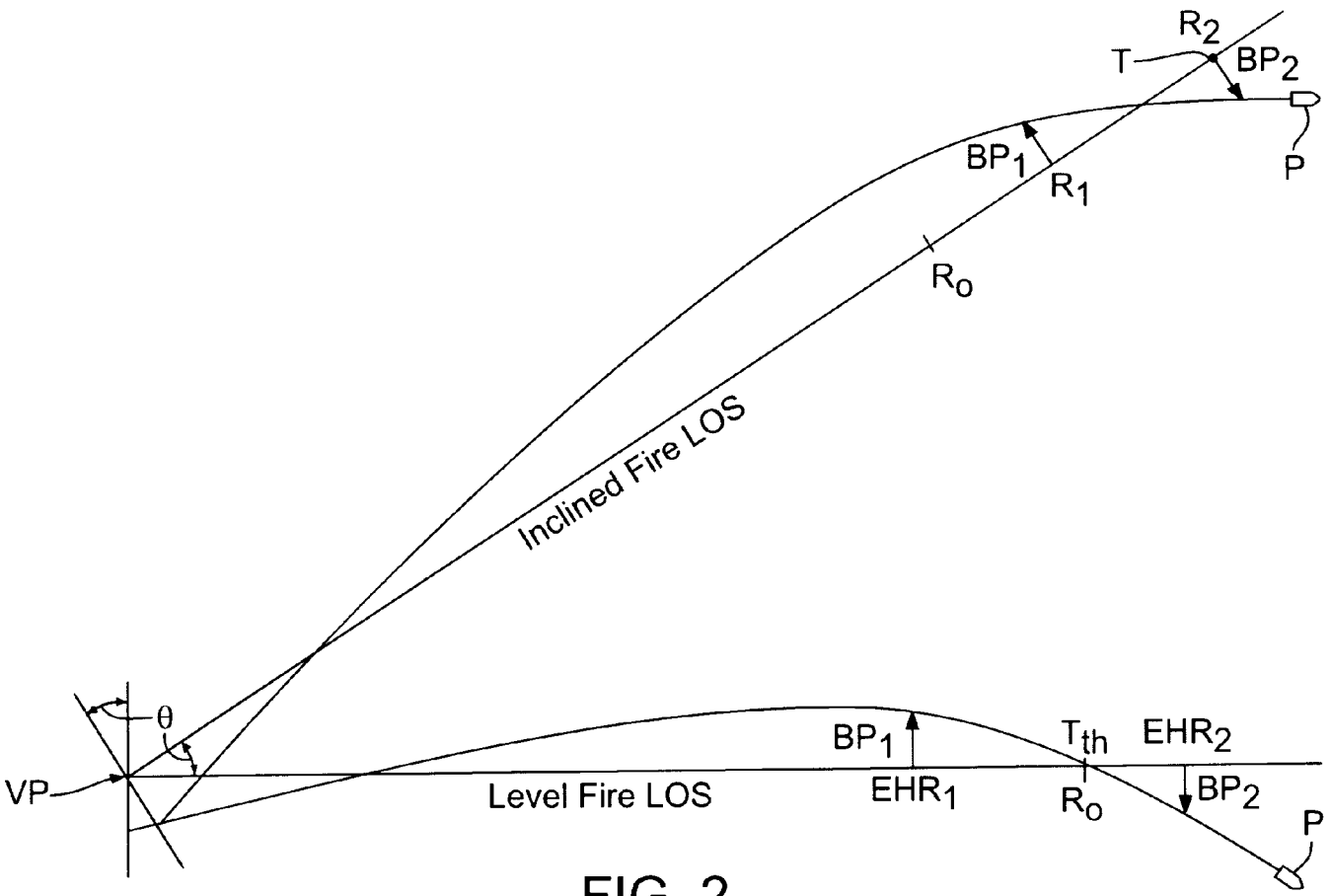
FIG. 2 is a schematic diagram illustrating measurements and factors in calculating an equivalent horizontal range (EHR)
Figure 3:
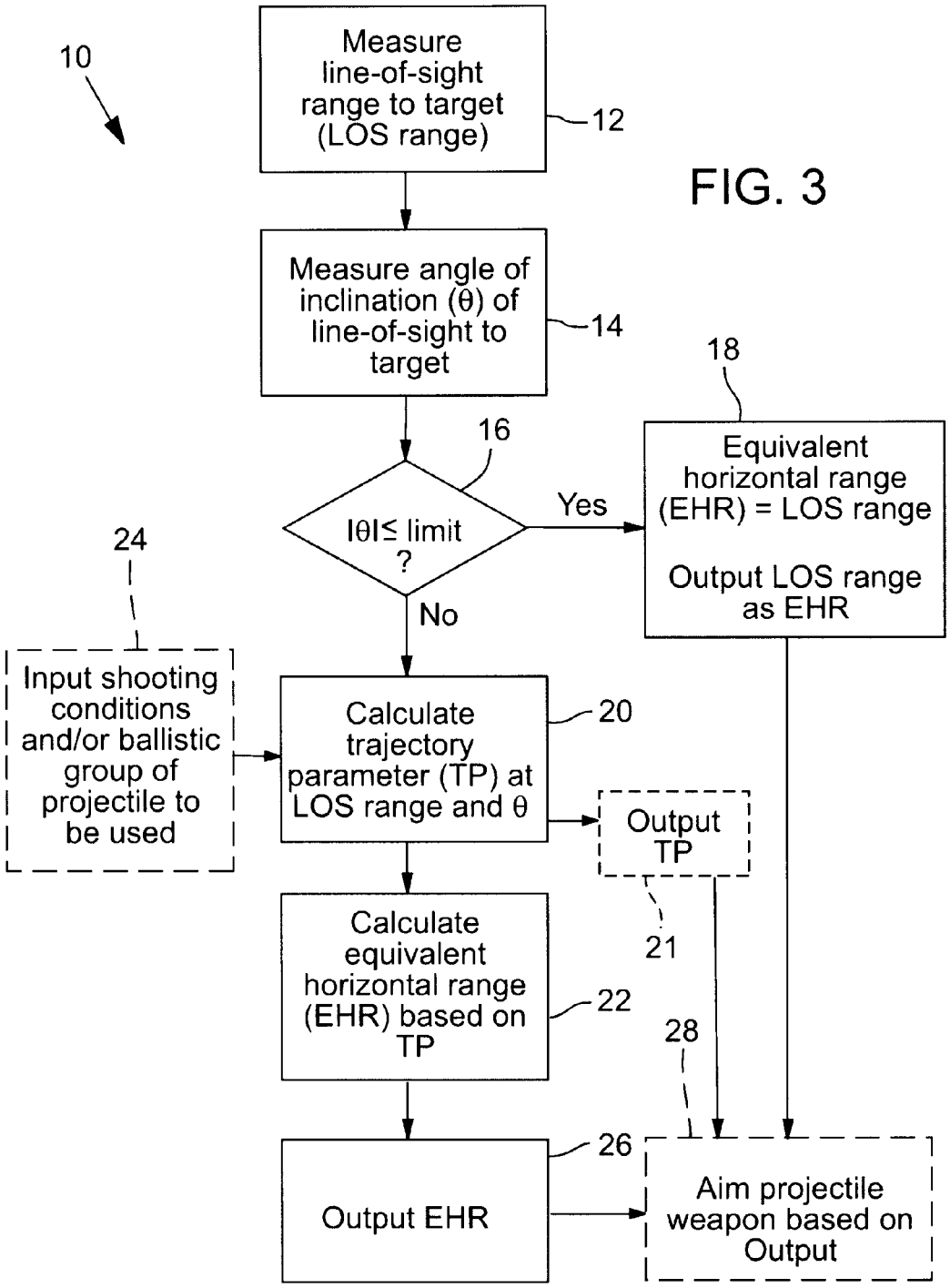
FIG. 3 is a flow chart showing method steps in accordance with an embodiment.

In accordance with one embodiment depicted in FIGS. 2 and 3, a method 10 of inclined shooting involves the calculation of an equivalent horizontal range (EHR) that may be used by the shooter to make a holdover or elevation adjustment for accurately aiming a projectile weapon at an elevated or depressed target located at a inclined line of sight (LOS) range that is different from the EHR. With reference to FIG. 2, a shooter at vantage point VP determines a line-of-sight range to a target. As in FIG. 1, a zero range $R_0$ represents the horizontal-fire distance at which the projectile weapon and aiming device are sighted-in. Line-of-sight ranges $R_1$ and $R_2$ to two different targets are depicted in FIG. 2, illustrating the usefulness of the method with respect to both positive and negative ballistic path heights $BP_1$ and $BP_2$ relative to the inclined fire LOS. For purposes of illustration, the steps of method 10 (FIG. 3) will be described with reference to a generic LOS range R to a target T, shown in FIG. 2 at range $R_2$. However, skilled persons will appreciate that the methods described herein are equally applicable to "near" LOS ranges $R_1$ at which the ballistic path height $BP_1$ is positive, as well as to "far" LOS ranges $R_2$ at which the ballistic path height $BP_2$ is negative. The LOS range R may be determined by a relatively accurate ranging technique, such as a lidar (laser ranging) or radar, or by a method of range estimation, such as optical range estimating methods in which a distant target of known size is bracketed in a scale of an optical device, as described in the '856 application at paragraphs [0038] and [0049] thereof.

Methods 10 in accordance with the present disclosure also involve determining an inclination $\theta$ of the inclined LOS between vantage point VP and the target T. The angle of inclination $\theta$ may be determined by an electronic inclinometer, calibrated tilt sensor circuit, or other similar device. For accuracy, ease of use, and speed, an electronic inclinometer for determining the angle of inclination θ may be mounted in a common housing with a handheld laser rangefinder 50 of the kind described below with reference to FIGS. 6-9.

FIG. 3 is a flow diagram depicting steps of inclined shooting method 10, including the initial steps of determining the LOS range R (step 12) and determining the inclination θ of the inclined LOS (step 14). With reference to FIG. 3, after LOS range R and inclination θ have been determined (steps 12 and 14), the method 10 may involve a check (step 16) to determine whether the absolute inclination |θ| is less than a predetermined limit under which the effects of inclination can be disregarded and the LOS range R can be regarded as the equivalent horizontal range (EHR) (step 18).

Archery ballistics exhibit a more significant difference between positive and negative lines of initial trajectory (uphill and downhill shots) since the initial velocity is relatively low, giving the effects of gravity more time to affect the trajectory than with bullets, which reach their targets much faster. Especially at long ranges, uphill shots experience more drop than downhill shots; therefore, when applying the method 10 for archery, the check 16 may involve comparing a positive inclination θ against a positive limit and a negative inclination θ against a negative limit that is different from the positive limit. Mathematically, such a check would be expressed as:

$$\{\text{lower_limit}\} \geq \theta \leq \{\text{upper_limit}\}?$$

If the result of check 16 is negative, then a predicted trajectory parameter TP is calculated or otherwise determined at the LOS range for a preselected projectile P shot from vantage point VP toward the target T (step 20). Trajectory parameter TP may comprise any of a variety of trajectory characteristics or other characteristics of a projectile calculable using ballistics software. For example, trajectory parameter TP at LOS range R may comprise one or more of ballistic path height (e.g., arrow path or bullet path), ballistic drop relative to line of initial trajectory (e.g., the bore line in FIG. 1), observed ballistic drop perpendicular to LOS (i.e., vertical ballistic drop×cos(θ+α)), velocity, energy, and momentum. In accordance with the embodiment described below with reference to FIGS. 2 and 4, for $R=R_2$, trajectory parameter TP may comprise ballistic path $BP_2$ (e.g., bullet path). In another embodiment, described below with reference to FIG. 5, the trajectory parameter of ballistic path comprises arrow path (AP). However, nothing in the figures or written description should be construed as limiting the scope of possible trajectory parameters to only ballistic path.

After the trajectory parameter TP has been calculated, the method may then output the trajectory parameter TP (step 21) or calculate EHR based on the trajectory parameter TP or parameters (step 22). At step 21, the trajectory parameter TP output may comprise ballistic path height BP expressed as a linear distance in inches or millimeters (mm) of apparent drop, or as a corresponding angle subtended by the ballistic path height (e.g., $BP_2$ in FIG. 2) in minutes of angle (MOA) or milliradians (mils). The TP output (step 21) may comprise a display of numerical ballistic path data in an electronic display device, such as a display 70 of rangefinder 50 (FIG. 7) or a reticle 210 of riflescope 200 (FIGS. 10-12), as further described below. The TP output (step 21) may also comprise graphical display of a holdover aiming recommendation in a rangefinder display (FIGS. 10-11), a riflescope reticle (FIGS. 12-13), an archery sight, or another aiming sight, based on the trajectory parameter of ballistic path BP.

In one method of calculating EHR, a reference ballistics equation for a level-fire scenario (θ=0) comprising a polynomial series is reverted (i.e., through series reversion) to solve for EHR based on a previously calculated ballistic path height BP (e.g., $BP_2$). As depicted in FIG. 2, $BP_2$ corresponds to $EHR_2$ under level-fire conditions. Thus, EHR is calculated as the range at which trajectory parameter TP would occur if shooting projectile P in a level-fire condition from the vantage point VP toward a theoretical target $T_{th}$ in a common horizontal plane with vantage point VP, wherein the horizontal plane coincides with the level fire LOS. Of course, the reference ballistics equation may be established to deviate slightly from horizontal without appreciable error. Consequently, the terms "horizontal", "level fire LOS", and other similar terms are preferably construed to allow for equations to deviate from perfect horizontal unless the context indicates otherwise. For example, when solving for EHR, the degree of levelness of the reference equations should facilitate calculation of EHR with sufficient accuracy to allow aiming adjustments for inclined shooting resulting in better than ±6 inches of error at 500 yards throughout the range of between −60 and 60 degrees inclination. Ballistic trajectories are generally flatter at steeper shooting angles and trajectories of different projectiles are therefore more similar. Consequently, the deviation tends to be less significant at very steep inclines.

The calculation of trajectory parameter TP, the calculation of equivalent horizontal range EHR, or both, may also be based on a ballistic coefficient of the projectile P and one or more shooting conditions. The ballistic coefficient and shooting conditions may be specified by a user or automatically determined at step 24. Automatically-determined shooting conditions may include meteorological conditions such as temperature, relative humidity, and barometric pressure, which may be measured by micro-sensors in communication with a computer processor for operating method 10. Meteorological conditions may also be determined by receiving local weather data via radio transmission signal, received by an antenna and receiver in association with the computer processor. Similarly, geospatial shooting conditions such as the compass heading of the LOS to the target and the geographic location of the vantage point VP (including latitude, longitude, altitude, or all three) may be determined automatically by a GPS receiver and an electronic compass sensor in communication with the computer processor, to ballistically compensate for the Coriolis effect (caused by the rotation of the Earth). Alternatively, such meteorological and geospatial shooting conditions may be specified by a user and input into a memory associated with the computer processor, based on observations made by the user.

User selection of shooting conditions and ballistic coefficient may also involve preselecting or otherwise inputting non-meteorological and non-geospatial conditions for storage in a memory associated with a computer processor on which method 10 is executed. The ballistic coefficient and certain shooting conditions, such as the initial velocity of projectile P (e.g., muzzle velocity, in the case of bullets), may be set by a user simply by selecting from two or more weapon types (such as guns and bows), and from two or more ballistic groupings and possibly three, four, five, six, seven or more groups, wherein each group has a nominal ballistic characteristic representative of different sets of projectiles having similar ballistic properties. The sets (groups) may be mutually-exclusive or overlapping (intersecting). A sighted-in range of a weapon aiming device and a height of the weapon aiming device above a bore line of a weapon may also be entered in this manner. In a rangefinder device 50 for operating the method, described below with reference to FIGS. 6 and 7, the weapon type and ballistic group may be selected from a menu of possible choices during a menu mode or setup mode of rangefinder device 50.

After a trajectory parameter TP has been calculated at step 20 or EHR has been calculated at step 22, method 10 then involves outputting TP or EHR in some form (step 21 or 26). For example, TP or EHR may be displayed via a display device, such as an LCD display, in the form of a numeric value specified in a convenient unit of measure. For example, TP output may be expressed as ballistic path height BP in inches or mm of apparent drop or as an angle (in MOA or mils) subtended by the ballistic path height BP. EHR may be expressed in yards or meters, for example. In other embodiments, BP or EHR may be effectively output via a graphical representation of the data, through the identification of a reticle aiming mark corresponding to the BP or EHR, for example, as described below with reference to FIGS. 10-13.

Once the EHR is output 26, it can then be employed to aim the projectile weapon (step 28) at target T along the inclined LOS at $R_2$. In one embodiment, a shooter merely makes a holdover or holdunder adjustment based on the calculated EHR, as if she were shooting under level-fire conditions—it being noted that wind effects, firearm inaccuracy, and shooter's wiggle are still in effect over the entire LOS range $R_2$. In another embodiment, the shooter adjusts an elevation adjustment mechanism of a riflescope or other aiming device based on the displayed EHR. Similar elevation adjustments may be made based on the display of the calculated trajectory parameter TP (step 21).

Ballistic Calculation Methods

Figure 4:
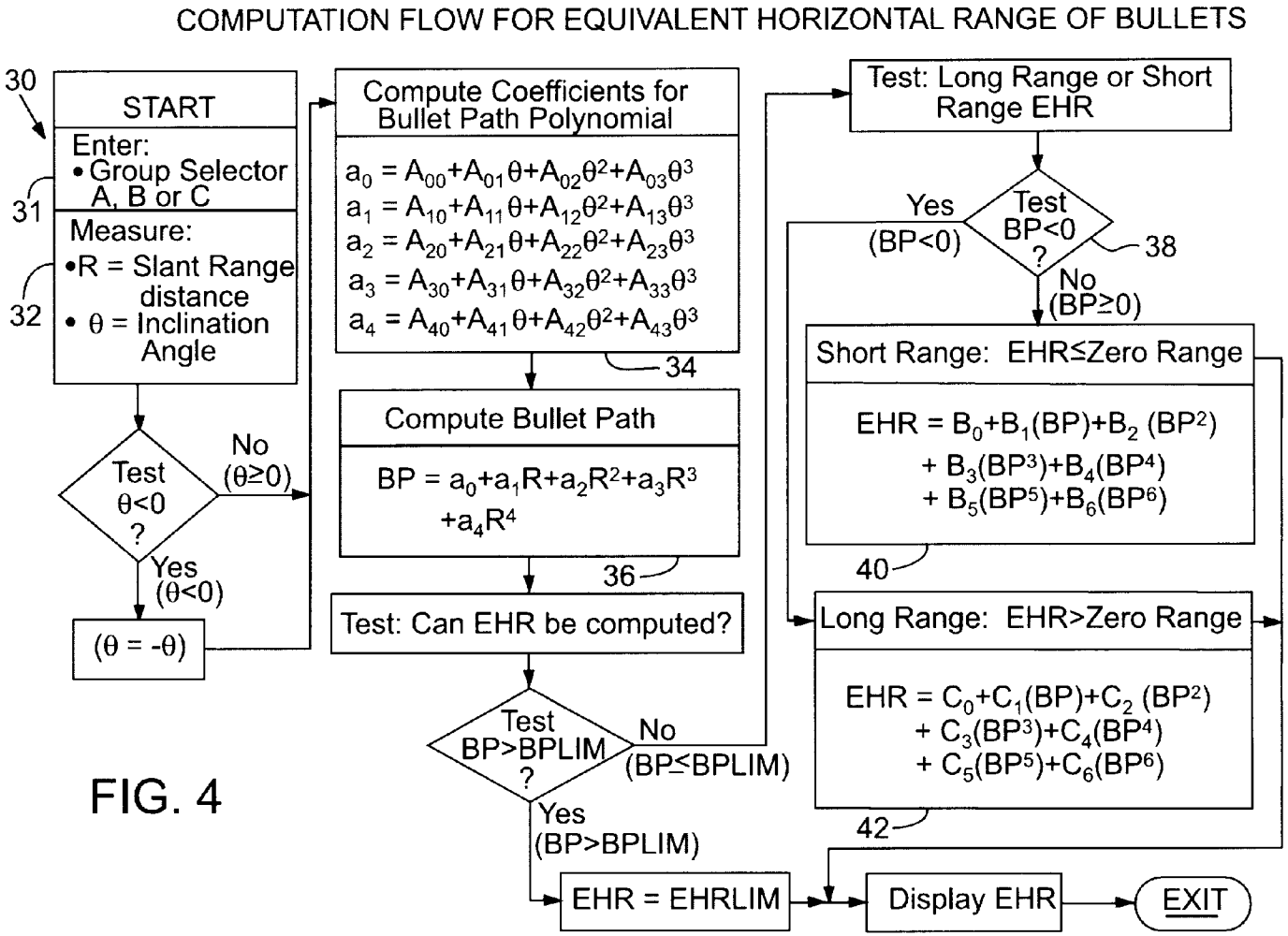
FIG. 4 is a computation flow diagram for solving EHR for bullets.

FIG. 4 summarizes details of one possible sequence of steps for calculating a trajectory parameter of bullet path (BP) and equivalent horizontal range (EHR) for bullets. The calculation sequence 30 begins with selection of a ballistic group (A, B, or C) in which the bullet and cartridge are listed (step 31). Ballistic grouping may effectively normalize groups of bullets having similar characteristics, based on their ballistic coefficients, muzzle velocities and masses. Listings of cartridges in the various groupings may be provided to the user by a printed table or software-generated information display, facilitating selection of the appropriate ballistic group. Reference trajectories for ballistic groups A, B, and C are set forth in TABLE 3, below. The other inputs to the calculations include the LOS range R and the inclination angle θ, which may be determined automatically by a handheld laser rangefinder with inclinometer (step 32). The calculation method involves solving the following polynomial equation for bullet path:

$$BP=a_0+a_1R+a_2R^2+a_3R^3+$$

(step 36), wherein the coefficients $a_0$, $a_1$, $a_2$, etc. are calculated from the inclination angle θ based on a series of polynomial equations 34 in which the coefficients thereof (identified in FIG. 4 as $A_{00}$, $A_{01}$, $A_{02}$, etc.) are different stored parameters for each ballistic group A, B, and C. A single equation 36 is suitable for both positive and negative angles of inclination, expressed as absolute angular values. After bullet path BP has been determined, the BP is then used as an input to one of two different reversions of the bullet path equation for θ=0 to solve for EHR. If bullet path BP is positive (test 38), then a "short-range EHR" polynomial equation is used (step 40), wherein $B_0, B_1, \ldots, B_6$ are parameters corresponding to the selected ballistic group. If BP is negative (test 38), then a "long-range EHR" polynomial equation is used (step 42), wherein $C_0, C_1, \ldots, C_6$ are parameters corresponding to the selected ballistic group. Each ballistic group also has an associated coefficient named BPLIM, which is an upper limit for BP in the computations shown in FIG. 4. Parameters $A_{00}$ to $A_{43}$, $B_0$ to $B_6$, and $C_0$ to $C_6$ are constants that are stored for each of the ballistic groups and recalled based on the selected ballistic group for purposes completing the calculations 30.

Figure 5:
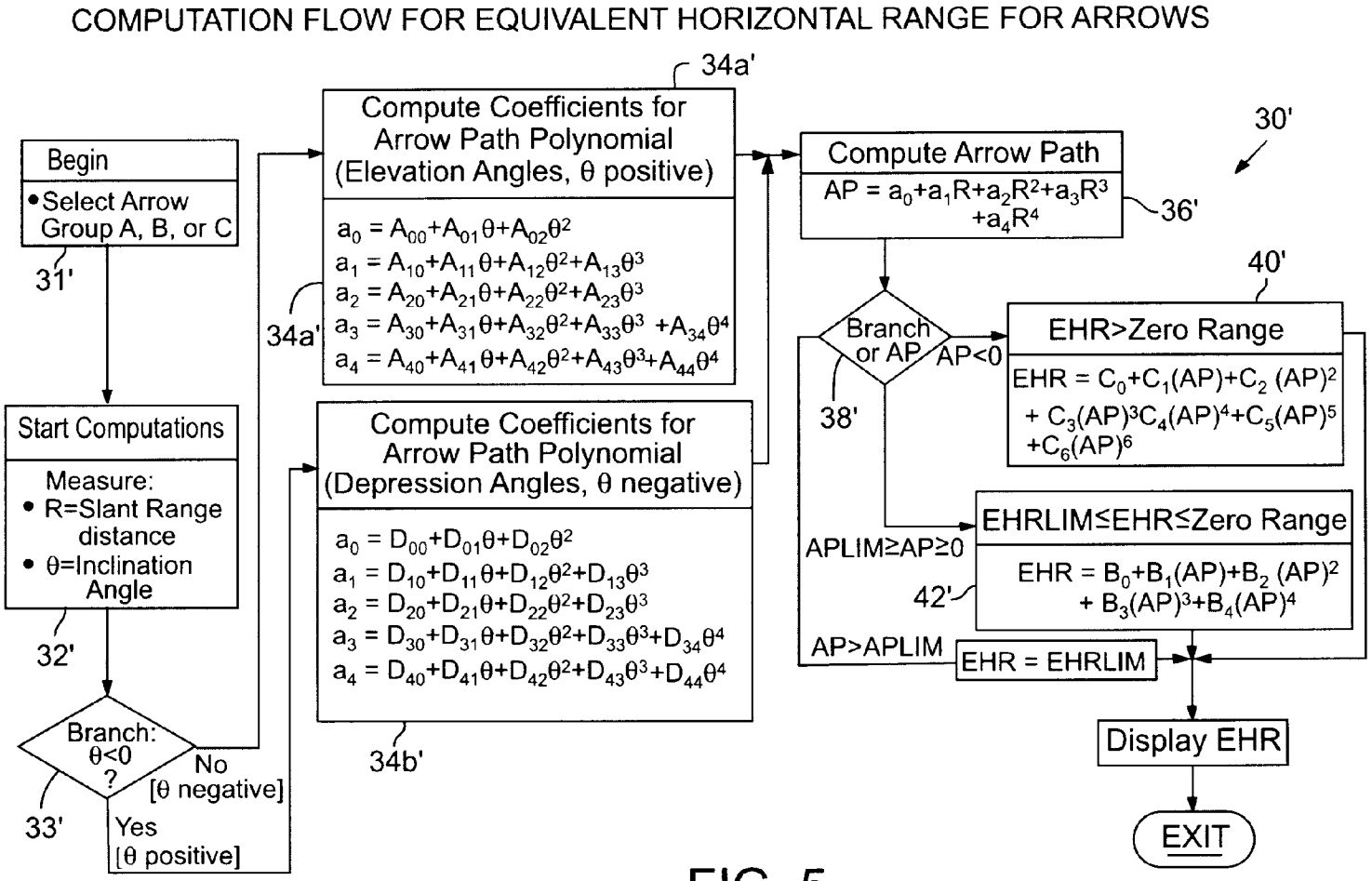
FIG. 5 is a computation flow diagram for solving EHR for arrows.

FIG. 5 illustrates a similar sequence of calculations 30' for archery. In FIG. 5 reference numerals 31', 32', 36', etc. indicate steps that correspond to respective steps 31, 32, 36, etc. of FIG. 4. However, unlike the calculations for bullets 30 (FIG. 4), the calculation of ballistic path for arrows 30' (hereinafter arrow path AP) must take into account whether the inclination angle is positive or negative (branch 33'), due to the increased flight time of arrows and attendant increased effects of gravity on their trajectory. For this reason, the calculations involve one of two different sets of coefficients $A_{ij}$ and $D_{ij}$, (for i=1, 2, 3, 4, 5 and j=1, 2, 3, 4, 5) depending on whether the inclination is positive (step 34*a'*) or negative (step 34*b'*). Parameters $A_{00}$ to $A_{43}$, $B_0$ to $B_6$, $C_0$ to $C_6$, $D_{00}$ to $D_{43}$, APLIM, and EHRLIM are constants that are stored in memory for each of the ballistic groups and recalled based on the selected ballistic group for purposes completing the calculations 30'.

Table 2 lists one example of criteria for ballistic grouping of bullets and arrows:

TABLE 2

| Ballistic group | Characteristic ballistic drop (without incline) |
|---|---|
| Arrow group A | Arrow drop of 20 to 30 inches from the 20-yard sight pin at 40 yards |
| Arrow group B | Arrow drop of 30 to 40 inches from the 20-yard sight pin at 40 yards |
| Arrow group C | Arrow drop of 10 to 20 inches from the 20-yard sight pin at 40 yards |
| Bullet group A | Rifles sighted in at 200 yards with 30 to 40 inches drop at 500 yards |
| Bullet group B | Rifles sighted in at 200 yards with 40 to 50 inches drop at 500 yards |
| Bullet group C | Rifles sighted in at 300 yards with 20 to 30 inches drop at 500 yards |

Arrow groupings may be more dependent on the launch velocity achieved than the actual arrow used, whereas bullet groupings may be primarily based on the type of cartridge and load used. Table 3 lists example reference trajectories from which the calculation coefficients of FIG. 4 may be determined for ballistic groups A, B, and C.

TABLE 3

| | |
|---|---|
| A | Winchester Short Magnum with Winchester 180 grain Ballistic Silvertip bullet at 3010 fps, having a level fire bullet path of −25.21 inches at 500 yards. |
| B | 7 mm Remington Magnum with Federal 150 grain SBT GameKing bullet at 3110 fps, having a level fire Bullet Path of −34.82 inches at 500 yards. |
| C | 7 mm-08 Remington with Remington Pointed Soft Point Core-Lokt bullet at 2890 fps, having a level fire Bullet Path of −45.22 inches at 500 yards. |

Alternatives to solving a series of polynomial equations also exist, although many of them will not provide the same accuracy as solving a polynomial series. For example, a single simplified equation for ballistic drop or ballistic path may be used to calculate a predicted trajectory parameter, and then a second simplified equation used to calculate EHR from the predicted trajectory parameter. Another alternative method of calculating EHR involves the "Sierra Approach" described in William T. McDonald, "Inclined Fire" (June 2003), incorporated herein by reference. Still another alternative involves a table lookup of a predicted trajectory parameter and/or interpolation of table lookup results, followed by calculation of EHR using the formula identified in FIG. 4. Yet another alternative involves determining both the predicted trajectory parameter and EHR by table lookup and interpolation, using stored sets of inclined-shooting data at various angles.

EXAMPLE

The following table (TABLE 1) illustrates an example of an EHR calculation and compares the results of aiming using EHR to aiming with no compensation for incline, and aiming by utilizing the horizontal distance to the target (rifleman's rule).

TABLE 1

| | |
|---|---|
| Load | .300 WSM, 165 grain Nosler Partition, 3050 fps muzzle velocity |
| Angle of inclination | 50° |
| Inclined line-of-sight range | 500 Yards |
| Equivalent Horizontal Range (EHR) | 389 Yards |
| Ballistic table hold over for 389 yards level fire | 18 inches |
| Horizontal leg of the triangle | 321 Yards |
| Ballistic table hold over for 321 yards | 8.5 inches |
| Error if horizontal leg is used | −9.5 inches |
| Ballistic table hold over for 500 yards level fire (no compensation for incline) | 39.5 inches |
| Error if no compensation for incline | +21.5 inches |

Rangefinder with Ballistic Range Calculation

Figure 6:
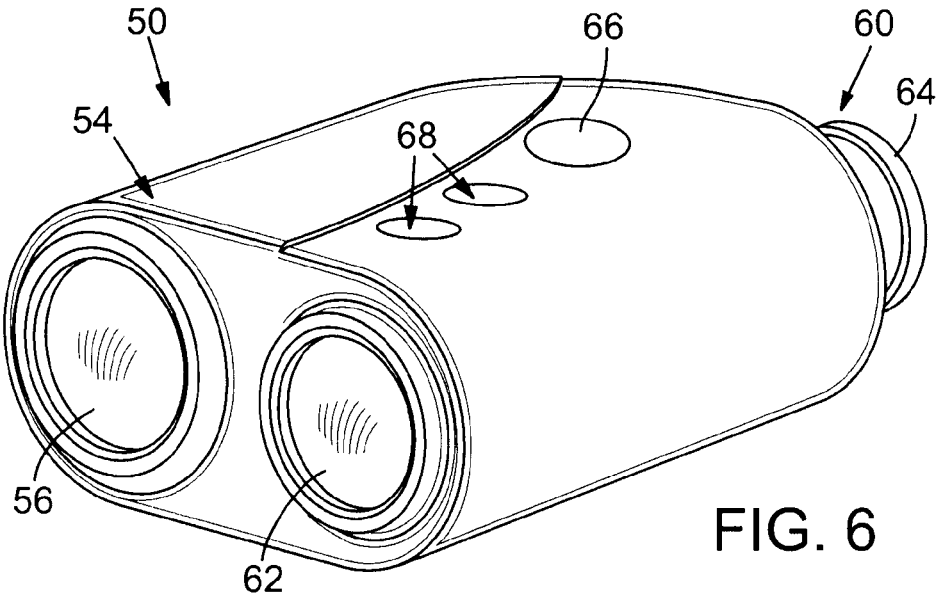
FIG. 6 is a pictorial view of a rangefinder according to an embodiment of a system for range measurement and ballistic calculations.

The above-described methods may be implemented in a portable handheld laser rangefinder 50, an embodiment of which is shown in FIG. 6, including a laser ranging system 54 having a lens 56 through which a laser beam is emitted and reflected laser light received for determining a range to the target. Rangefinder 50 may be targeted using an integrated optical targeting sight 60 including an objective 62 and an eyepiece 64, through which a user views the distant target. A power button 66 turns on certain electronics of rangefinder 50, described below with reference to FIG. 9, and causes rangefinder 50 to emit laser pulses and acquire range readings. A pair of menu interface buttons 68 are provided on rangefinder 50 for operating menus for inputting setup information and enabling functions of the rangefinder, as described in more detail in U.S. patent application Ser. No. 11/265,546, filed Nov. 1, 2005, which is incorporated herein by reference.

Figure 7:
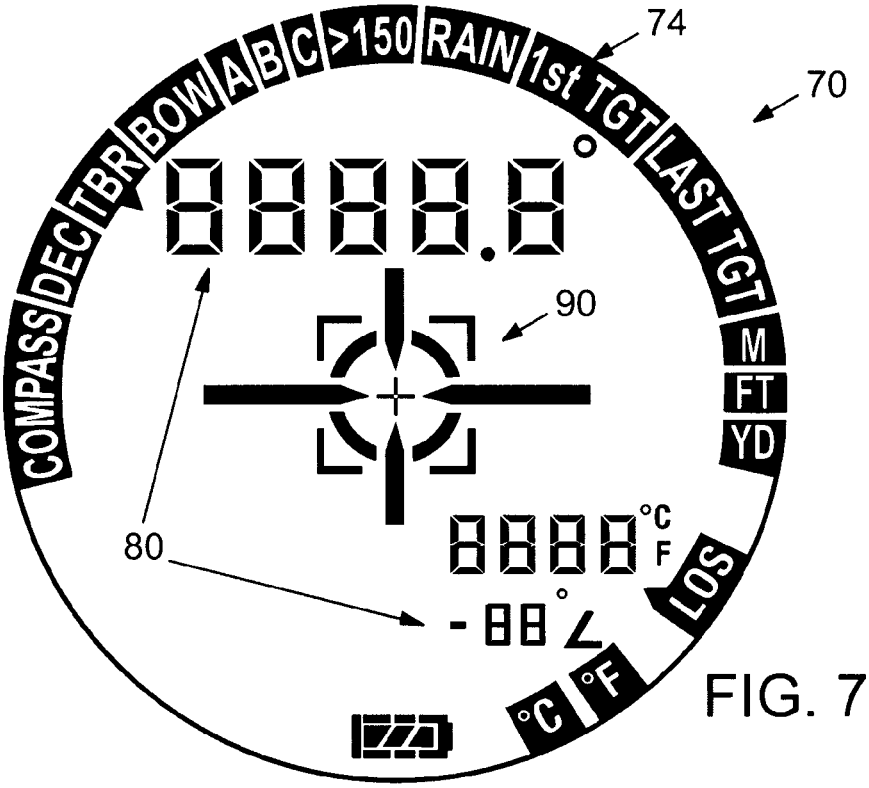
FIG. 7 is an enlarged view of an electronic display as viewed through an eyepiece of the rangefinder.

FIG. 7 shows elements of a display 70 which is preferably placed in the field of view of the targeting sight 60 of rangefinder 50. Display 70 is preferably formed by a transmissive LCD display panel placed between objective 62 and eyepiece 64. However, other display devices may be used, including displays generated outside of the optical path of the targeting sight 60 and injected into the optical path of the targeting sight 60, for example by projecting a reticle display onto a prism or beam-combining element (reverse beam splitter). Display 70 may include a circular menu 74 along its perimeter, which can be navigated using buttons 66, 68 to select one or more of various functions of rangefinder 50. The icons labeled >150, 1st TGT, LAST TGT, M/FT/YD, LOS relate to ranging functions and modes of display. The TBR icon stands for TRUE BALLISTIC RANGE™ and, when selected, activates calculation methods for determining equivalent horizontal range EHR. The icon for BOW toggles between bullet and arrow calculation methods of FIGS. 4 and 5, and between ballistic groupings for bullets and arrows, which are selectable from the menu segments of the A/B/C menu icon.

Figure 8:
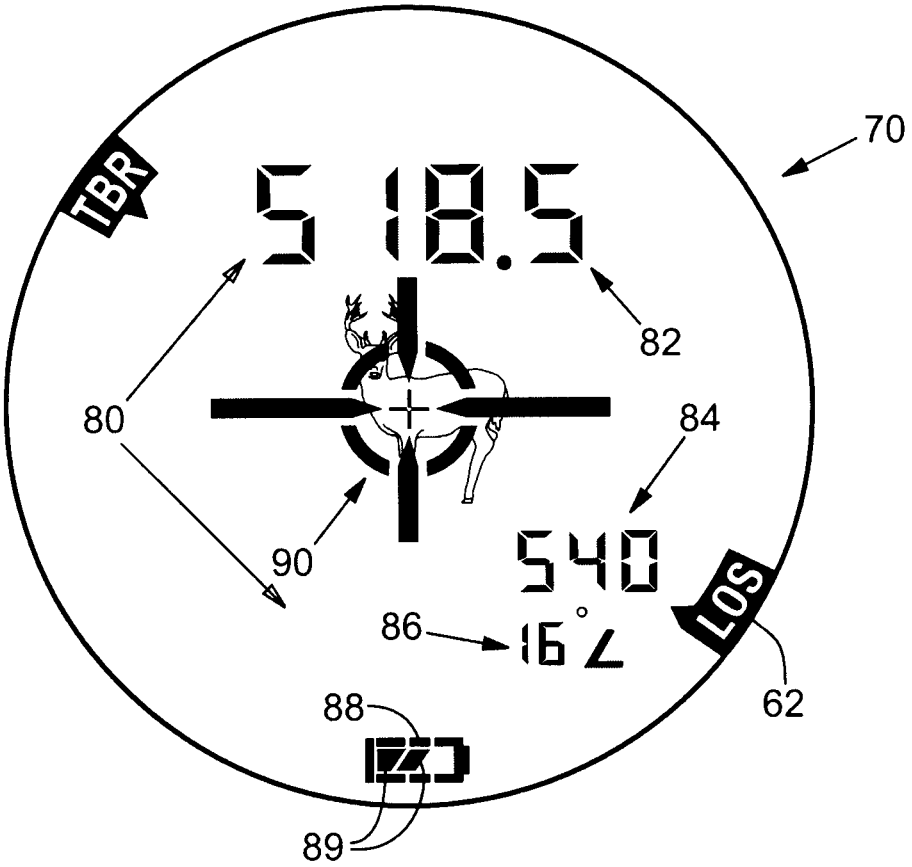
FIG. 8 is an elevation view of the display of FIG. 7 showing detail of displaying of calculated and measured data.

Display 70 may also include a data display 80 including a primary data display section 82 and a secondary data display section 84. Primary data display section 82 may be used to output EHR calculations, as indicated by the adjacent icon labeled "TBR". Secondary numerical display 84 may be used to output the LOS range, as indicated by the adjacent icon labeled "LOS". As shown in FIG. 8, a third data display section 86 is provided for displaying an inclination angle, measured by an inclinometer sensor 110 (FIG. 9) of rangefinder 50. Still further display sections may be provided for displaying data representative of a trajectory parameter, such as ballistic path height BP, vertical ballistic drop, energy, momentum, velocity, etc. at the target range. In one embodiment, based on ballistic path height BP or another trajectory parameter TP, another display section (not shown) may display a recommended holdover adjustment in inches, millimeters, or mils, at the target range or a recommended elevation adjustment in MOA or mils.

As also depicted in FIG. 8, two or more items of data, such as EHR, LOS range, and angle of inclination may be displayed concurrently in display 70. Additional items of data, such as MOA or holdover/drop in inches or mm may also be displayed concurrently in display 70. A battery power indicator 88 is provided in display 70 for indicating an estimate of the amount of battery power remaining. As the batteries in the rangefinder 50 are drained, one or more display segments 89 in the center of the battery power indicator 88 are turned off to indicate the battery power level has dropped. A user-configurable targeting reticle display 90 is also preferably included in display 70, for facilitating aiming of rangefinder 50. The many segments of reticle display 90 allow it to be reconfigured in various ways, such as the one shown in FIG. 8.

Figure 9:
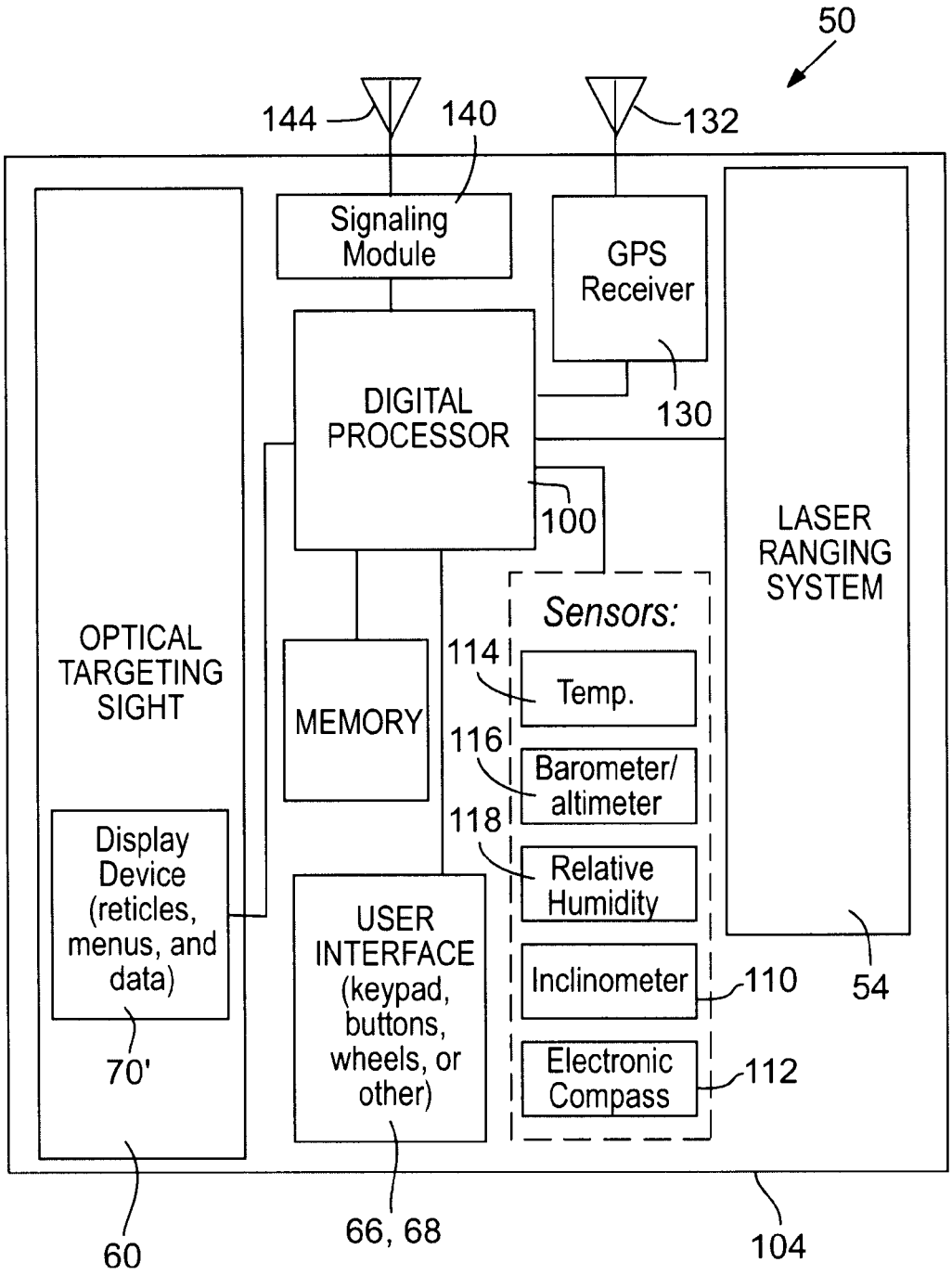
FIG. 9 is schematic block diagram of the riflescope of FIG. 6.

FIG. 9 is a block diagram illustrating components of rangefinder 50. With reference to FIG. 9, rangefinder 50 includes a computer processor or digital processor 100, such as a microprocessor or digital signal processor (DSP), operatively coupled to laser ranging system 54, display device 70', and user interface 66,68. Targeting sight 60 and laser ranging system 54 are aligned relative to each other and supported in a common housing 104, which may include an internal carriage or frame. An inclinometer sensor 110 is mounted to a support structure in rangefinder 50 in alignment with ranging system 54 and targeting sight 60 for measuring the inclination θ of the line of sight (LOS) between vantage point VP and the target T (FIG. 2). The ballistic calculations described above with reference to FIGS. 1-5 may be performed by the digital processor 100 of rangefinder 50 automatically after a laser ranging measurement is made via the ranging system 54.

To facilitate accurate ballistics calculations, digital processor 100 is in communication with inclinometer 110 and other sensors, such as an electronic compass 112, temperature sensor 114, barometer/altimeter sensor 116, and relative humidity sensor 118. The data from these sensors may be used as shooting condition inputs to ballistic calculation software operating on digital processor 100 for performing the methods described above with reference to FIGS. 1-5. A memory 124 readable by digital processor 100 is preferably provided for storing the software program, sensor data, and user-defined settings, among other information. In some embodiments, memory 124 may also store data tables including ballistic coefficients for various bullets and arrows or groups thereof. And in some embodiments, memory 124 may store data tables including ballistic tables with predicted trajectory parameters for known shooting conditions (including a range of angles) and tables with EHR data (under level-fire conditions) for a range of trajectory parameters. A GPS receiver 130 and antenna 132 for acquiring geographic location data from GPS satellite signals may also be included in rangefinder 50 in operative association with digital processor 100. Finally a signaling module 140, which may include an antenna 144, may be coupled to digital processor for transmitting signals representative of ballistic calculation data calculated by digital processor 100, such as one or more trajectory parameters, equivalent horizontal range, elevation adjustments and holdover adjustments.

Graphical Display of Ballistic Holdover Aiming Data

As mentioned above, the output of BP or EHR (step 18, 21, or 26 in FIG. 3) may be displayed via a graphical representation of a corresponding aiming mark of a weapon aiming device reticle or targeting sight. In one embodiment of such a display method, a facsimile of a riflescope reticle is displayed in the display device 70' of rangefinder 50, then an aiming mark of the facsimile reticle corresponding to the output BP or EHR is identified by highlighting, emphasizing, flashing, coloring, or otherwise changing the appearance of the aiming mark to accomplish a graphical display of the recommended aiming point in relation to the overall reticle pattern. This graphical display communicates to the user which of several aiming marks or points on the corresponding riflescope reticle is recommended for use in holdover aiming of a firearm that is separate from the rangefinder. In another embodiment, the rangefinder 50 and targeting sight 60 are integrated in a common housing with a riflescope or other weapon aiming device, in which case the same sighting device and reticle display may be used for aiming the rangefinder 50 and for aiming the projectile weapon utilizing the graphical holdover aiming display methods described herein. In still another embodiment, BP or EHR data is transmitted via wires or wirelessly by signaling module 140 and antenna 144 of rangefinder 50 for receipt by a riflescope or other aiming device, and subsequent display using the graphical display methods described herein.

Figure 10:
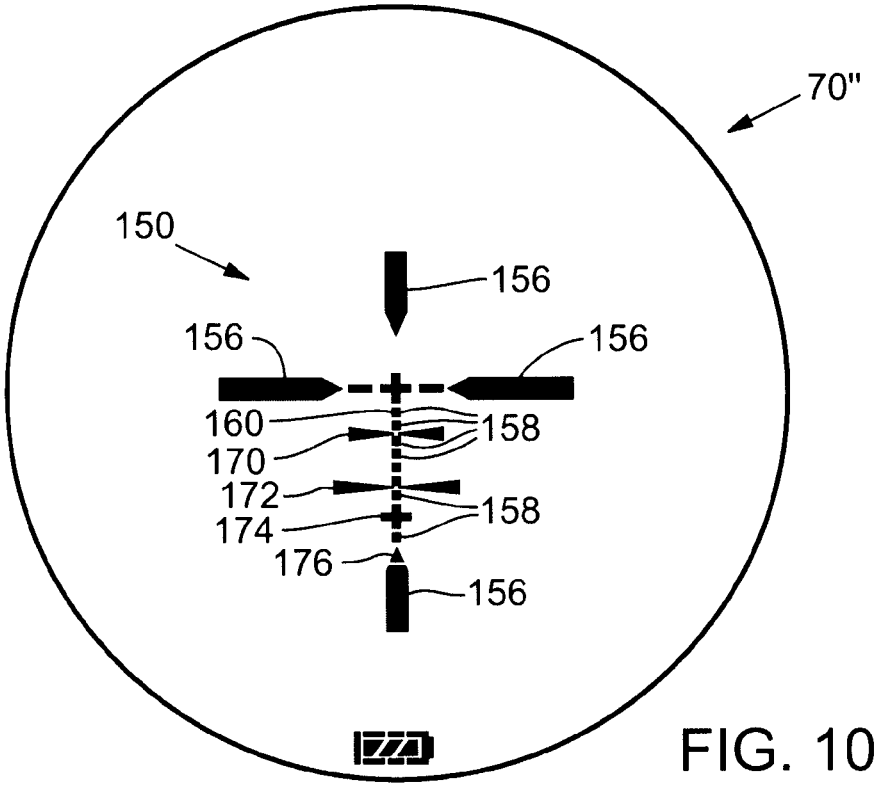
FIG. 10 is a pictorial view showing detail of an alternative targeting reticle and information display for a rangefinder.
Figure 12:
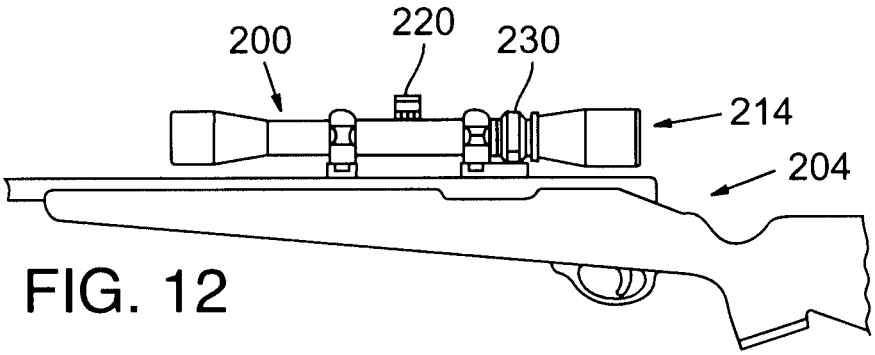
FIG. 12 is a side elevation view of a gun and riflescope.
Figure 13:
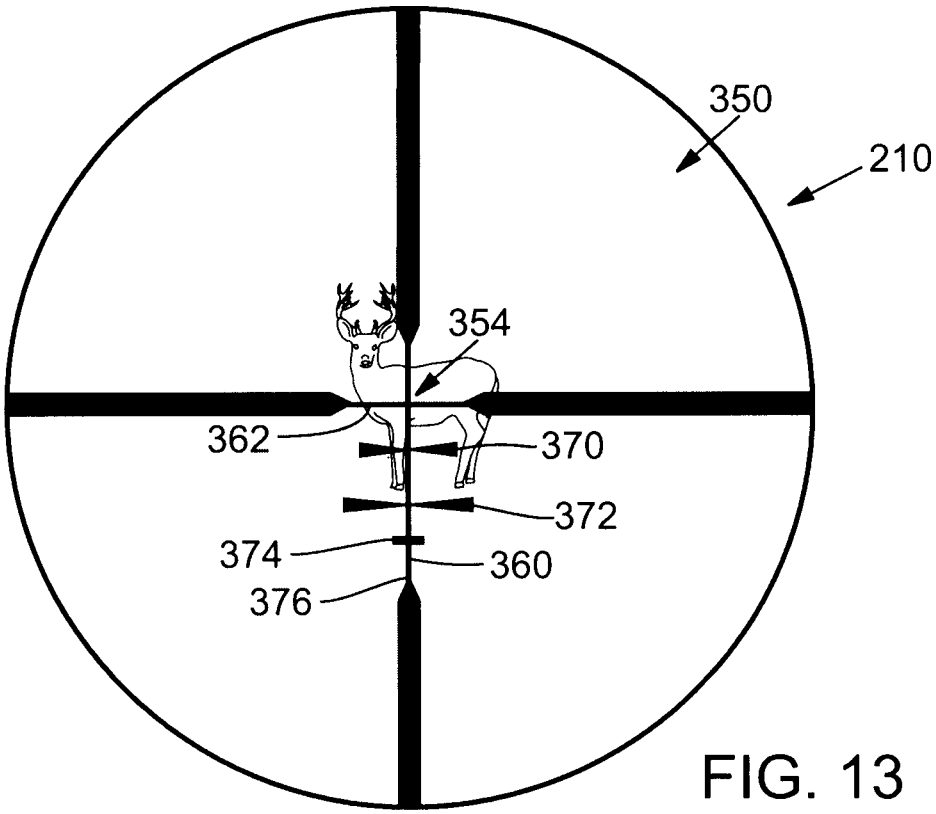
FIG. 13 is an enlarged pictorial view showing detail of a ballistic reticle of the riflescope of FIG. 12.

FIG. 10 shows a pictorial view of an electronic display 70" of rangefinder 50, in accordance with one embodiment, including a segmented LCD targeting display 150 which is a facsimile of a ballistic reticle 350 of a riflescope 200 illustrated in FIGS. 12-13. Details of ballistic reticle 350 are described in the '856 application in connection with the Ballistic Aiming System™ (BAS™) technology of Leupold & Stevens, Inc. With reference to FIGS. 9-10, a rangefinder aiming mark 154 of targeting display 150 serves as an aim point of targeting sight 60 for aiming the rangefinder 50 and acquiring a range measurement. Rangefinder aiming mark 154 also represents a primary aiming mark 354 (a/k/a crosshair or center point) of ballistic reticle 350 (FIG. 13) corresponding to a point-blank range or sighted-in range of a weapon 204 (FIG. 12) to which a riflescope 200 or other aiming device incorporating the ballistic reticle 350 is mounted. Targeting display 150 preferably includes heavy posts 156 radiating from the rangefinder aiming mark 154 for guiding the user's eye to aiming mark 154 and for rough aiming in poor light conditions when the finer aiming mark 154 may be difficult to see. Arranged below the rangefinder aiming mark 154 of targeting display 150 are a series of holdover aiming marks including segments 156 of a vertical sight line 160 of targeting display 150 and multiple spaced-apart secondary aiming marks 170, 172, 174, 176. Secondary aiming marks 170, 172, 174, and 176 are shaped similar to and correspond to respective secondary aiming marks 370, 372, 374, and 376 of ballistic reticle 350. As described in the '856 application, secondary aiming marks 370, 372, 374, and 376 are spaced apart below primary aiming mark 354 for accurate indication of bullet drop at corresponding incremental ranges of 300, 400, 450 and 500 yards when the riflescope 200 is sighted in at 200 yards. (As used herein, the term "sighted-in" refers to the calibration or zeroing of the elevation adjustment whereby the point of aim of the primary aiming mark 354 coincides with the point of impact of the projectile on a target at 200 yards.) For improved accuracy, the segments 156 represent ranges in between the incremental ranges of the primary and secondary aiming marks 354, 370, 372, 374, and 376. Of course, the ranges at which the various aiming marks of ballistic reticle 350 may be used to accurately aim the weapon will depend on the sighted-in range, the particular ballistic characteristics of the projectile, and the spacing of the aiming marks, among other factors.

Figure 11:
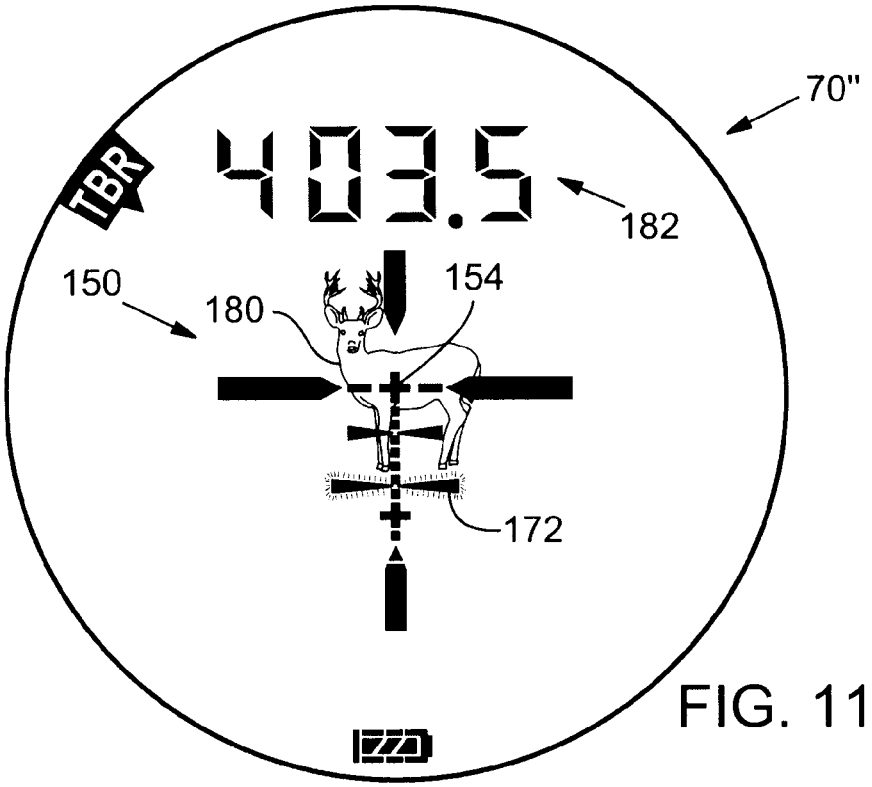
FIG. 11 is a pictorial view of the targeting reticle and information display of FIG. 10, illustrating the graphical display of a recommended holdover aiming adjustment.

Use of the targeting display 150 and the graphical display method is illustrated in FIG. 11. With reference to FIGS. 9 and 11, a user first aims the targeting sight 60 of rangefinder 50 so that the aiming mark 154 of targeting display 150 is superposed in the field of view over a target 180. While aiming the rangefinder 50 at target 180, the user activates rangefinder 50 by depressing power button 66 (FIG. 6) to trigger a laser ranging measurement of LOS range and subsequent calculation or lookup of ballistic path BP or equivalent horizontal range EHR based on LOS range, inclination angle to target, and other fact ors, as described above with reference to FIG. 3. The output of BP or EHR is then presented to the user in the form of a graphical identification of the corresponding aiming mark 154, 156, 170, 172, 174, or 176. A numerical display of EHR 182 may also be displayed in electronic display 70", as depicted in FIG. 11. In the example illustrated in FIG. 11, the EHR to target 190 is determined to be 403.5 yards and the corresponding holdover aiming mark is secondary aiming mark 172 (representing secondary aiming mark 372 of ballistic reticle 350—i.e., the aim point for a target at 400 yards in level-shooting conditions). Secondary aiming mark 172 may be flashed multiple times per second (as illustrated in FIG. 11) or otherwise changed in appearance to identify it and the corresponding secondary aiming mark 372 of reticle 350 as the aiming mark recommended for shooting at the target 180. Other modes of graphical identification include changing a color, size, or brightness of the corresponding holdover aiming mark of targeting display 150.

The above-described method of presenting EHR or BP output in a graphical display that is a facsimile of reticle 350 of the weapon aiming device may help avoid human errors that could otherwise result from attempting to manually convert numerical BP or EHR data or using it to manually determine which of several secondary aiming marks of riflescope reticle 350 should be used to aim the weapon.

To facilitate accurate representation of the holdover aiming point in targeting display 150, the reticle pattern of the display 150 may comprise a collection of independently-controllable display segments, as illustrated in FIGS. 10-11 having a relatively high resolution. In another embodiment (not shown), the entire display 150 may be pixilated and addressable by a display controller so that a single pixel or group of pixels may be selectively flashed or otherwise controlled independently of the others to emphasize a holdover aiming mark corresponding to the BP or EHR. Pixels of a pixilated display could also be driven to generate a display of a selected reticle of a weapon sight (from a menu of reticle styles), a rangefinder setup menu, a rangefinder targeting reticle, a data display, and various other display elements.

Remote Control for Aiming Adjustment

In another embodiment, the BP, EHR, or corresponding aiming mark may be determined by rangefinder 50, but displayed or identified in a separate, remote device, such as a riflescope that receives from the rangefinder device a radio frequency signal representative of the BP, EHR, or corresponding reticle aiming mark. The holdover aiming mark or point may be emphasized or identified in the riflescope reticle by intermittently blinking or flashing the corresponding reticle aiming mark, or by merely displaying the reticle aiming mark while blanking other surrounding reticle features. In other embodiments, the reticle aiming mark may be emphasized relative to other reticle features, by a color change, intensity change, illumination, size or shape change, or other distinguishing effect. In other embodiments, the BP or EHR or other data calculated by rangefinder 50 may be utilized for automated elevation adjustment in a riflescope or other sighting device.

With reference to FIGS. 9 and 12, signaling module 140 and antenna 144 of rangefinder 50 may be configured to send radio frequency signals to riflescope 200 (FIG. 12) mounted on a firearm 204 or to another weapon aiming device (not shown). Radio signals may be used to wirelessly feed or control a reticle display 210 (FIG. 13) of riflescope 200 viewable through a riflescope eyepiece 214 for displaying ballistics data in the field of view and/or for other purposes. Wireless data transmission enables the rangefinder 50 to be separate from the firearm and protected from the effects of recoil and other harsh environmental conditions to which riflescopes are typically exposed. For example, rangefinder 50 may be held by a first person—a spotter—standing several meters away from a shooter holding a rifle 204 with a riflescope 200 that receives data wirelessly from rangefinder 50. Rangefinder 50 may also transmit data wirelessly to several different riflescopes or other devices substantially simultaneously, allowing a single spotter to provide data to a group of shooters.

In one embodiment, the signals transmitted by signaling module 140 may include information representative of elevation adjustments to be made in riflescope 200 (in minutes of angle (MOA) or fractional minutes of angle, such as ¼ MOA or ½ MOA) based on ballistics calculations made by digital processor 100. Elevation adjustments expressed in MOA or fractions thereof may be displayed in reticle 210 or effected in riflescope 200 via manual adjustment of an elevation adjustment knob 220, a motorized elevation adjustment mechanism, or other means, such as by controlling or shifting reticle display 210 or reticle 350 for offsetting an aiming mark in the amount of aiming adjustment needed, or to show, highlight, or emphasize a fixed or ephemeral aiming mark corresponding to the EHR calculated by digital processor 100. The kind of data needed to make such an adjustment or aiming mark may depend on whether riflescope reticle 210 is in the front focal plane or the rear focal plane of riflescope 200.

When the recommended elevation adjustment is displayed (in MOA or otherwise) in the reticle display 210 of riflescope 200, it may be updated dynamically as the user manually adjusts an elevation setting of riflescope 200 via an elevation adjustment knob 220 or other means. To enable the recommended elevation adjustment display to be updated dynamically, the elevation adjustment knob 220 may include a rotary encoder that provides feedback to a display controller of the riflescope 200 or to the digital processor 100. Dynamic updating of the recommended elevation adjustment may enable the reticle display 210 to show the amount of adjustment remaining (e.g., remaining MOA or clicks of the adjustment knob needed) as the user adjusts elevation, without requiring constant communication between the riflescope 200 and rangefinder 50 during the elevation adjustment process. Dynamic updating of the remaining adjustment needed may facilitate operation of the rangefinder 50 and the riflescope 200 sequentially by a single person. In another embodiment, the rangefinder 50 may communicate constantly with riflescope 200, which may allow two people (e.g., a shooter working with a spotter) to more quickly effect accurate aiming adjustments.

Signaling module 140 may include an infrared transceiver, Bluetooth™ transceiver, or other short-range low-power transceiver for communication with a corresponding transceiver of riflescope 200, for enabling 2-way communication while conserving battery power in rangefinder 50 and riflescope 200. Data for controlling reticle 210 and elevation adjustment mechanism 220 may be transmitted via Bluetooth or other radio-frequency signals. Also, because Bluetooth transceivers facilitate two-way communication, the rangefinder 50 may query riflescope 200 for a current elevation adjustment setting, a power adjustment setting, and other information, such as the type of riflescope 200 and reticle 210 used. This data may then be taken into account in ballistics calculations performed by digital processor 100. Elevation adjustment and power adjustment settings of riflescope 200 may be determined by rotary position sensor/encoders associated with elevation adjustment knob 220 and power adjustment ring 230, for example.

Alternatively, signaling module 140 may include a cable connector plug or socket for establishing a wired connection to riflescope 200. A wired connection may avoid the need to have delicate electronics and battery power onboard riflescope 200. Wired and wireless connections may also be made between signaling module 140 and other devices, such as bow-sights (including illuminated pin sights and others), PDAs, laptop computers, remote sensors, data loggers, wireless data and telephone networks, and others, for data collection and other purposes.

Holdover indication in a riflescope, bow sight, or other optical aiming device may be achieved by emphasizing an aiming mark of the sight that corresponds to the EHR calculated by rangefinder 50. In ballistic reticle 350, a primary aiming mark 354, which may be formed by the intersection or convergence of a primary vertical aiming line 360 with a primary horizontal aiming line 362, coincides with a reference sighted-in range (such as 200 yards horizontal). As described above and in the '856 application, secondary aiming marks 370, 372, 374, and 376 are spaced along primary vertical aiming line 360 and identify holdover aiming points at which bullet impact will occur at incremental ranges beyond the sighted-in range.

As illustrated in FIG. 13, secondary aiming marks 370, 372, 374 and 376 of reticle 350 are designated by three spaced-apart aiming marks, including converging arrow heads and hash marks crossing the primary vertical aiming line 360. The various aiming marks and lines of reticle 350 may be independently controllable for display or emphasis, such as by flashing one or more of the aiming marks in the field of view of the rangefinder, in a manner similar to the way in which elements of rangefinder targeting display 150 of FIG. 10 are identified, as described above. In response to signals received from rangefinder 50, a selected one of the primary or secondary aiming marks 354, 370, 372, 374, 376 corresponding most closely to the EHR may be displayed, intermittently flashed, or otherwise emphasized to graphically indicate to the shooter which of the aiming marks should be used to aim firearm 204. This greatly simplifies aiming adjustment.

Unlike an automatic adjustment of the elevation adjustment (e.g., via a motorized knob 220), a graphical display of the holdover aiming adjustment in reticle 350 of riflescope 200, may give a user increased confidence that the aiming adjustment has been effected properly and that no mechanical malfunction has occurred in the elevation adjustment. Graphical display of aiming adjustment in the reticle display also allows the shooter to retain complete control over the aim of riflescope 200 and firearm 204 at all times, may reduce battery consumption, and may eliminate possible noise of adjustment motors of knob 220.

It will be obvious to those having skill in the art that many changes may be made to the details of the above-described embodiments without departing from the underlying principles of the invention. The scope of the present invention should, therefore, be determined only by the following claims.

The invention claimed is:

1. A method of determining a replacement distance to be taken into account instead of the target distance when taking aim on a target located at a line-of-sight target distance R and an inclination angle between a line of sight to the target and a horizontal plane, wherein the replacement distance is determined by applying a correction function to the target distance R wherein the correction function depends not on the ballistic coefficient and the muzzle velocity of the used ammunition, rather the correction function is dependent on the target distance R and the inclination angle.

2. The method according to claim 1, wherein the ammunition has an approximately flat trajectory.

3. The method according to claim 1, wherein an equivalent horizontal range is determined as the replacement distance by applying the correction function to the target distance R, and a value for the degree of correction is assigned respective to a pair of values representing the target distance R and the inclination angle.

4. The method according to claim 1, wherein a correction factor is used as the correction function, and the equivalent horizontal range is calculated by multiplying the target distance R by the correction factor.

5. The method according to claim 4, wherein the correction factor is determined from a correction factor table in which a value for the degree of correction is assigned respectively to a pair of values representing the target distance R and the inclination angle.

6. The method according to claim 5, wherein a value of the correction factor is calculated by an interpolation from the correction factor table.

7. The method according to claim 5, wherein valued for the correction factors in the correction factor table are calculated by means of a ballistics program from data pertaining to the cartridge load of an ammunition type and a mean value is derived from values of correction factors to different cartridge loads respectively.

8. The method according to claim 1, wherein the correction function includes a correction factor table, and at least three different cartridge loads are used to determine the correction factor table.

9. The method according to claim 1, wherein environmental parameters, in particular barometric pressure, relative humidity or ambient temperature, are also taken into account in the correction function.

10. The method according to claim 1, wherein the replacement distance is determined for taking aim with a weapon which has been zeroed-in on the horizontal.

11. A method of determining a replacement distance between a vantage point and a point of impact of a projectile in a same horizontal plane as the vantage point, whereby a target distance R between the vantage point and a target disposed on a line of sight is determined, and whereby an inclination angle subtended by the line of sight and the horizontal plane is determined, wherein a correction function is determined from the target distance R and the inclination angle wherein the correction function is not dependent on the ballistic coefficient and the muzzle velocity of used ammunition, rather the target distance R is changed by applying the correction function to it in order to fix the replacement distance in the horizontal plane.

12. A device for determining a replacement distance between a location and a point of impact of a projectile in a same horizontal plane as the location for taking aim at a target in order to take a shot at an angle from an inclination angle, with a display for a value of the replacement distance, wherein the device comprises: a distance meter for measuring a target distance R, an inclination sensor for measuring the inclination angle between a line of sight to the target and the horizontal plane, and a microprocessor configured to calculate the replacement distance by applying a correction function to the target distance R, the microprocessor retrieves a value for the degree of the correction function from a memory, and a value for the degree of the correction function is assigned respectively to a pair of values representing the target distance R and the inclination angle.

13. The device according to claim 12, wherein the microprocessor is configured to calculate the replacement distance by multiplying the target distance R by a correction factor.

14. The device according to claim 13, wherein the microprocessor is configured to determine the correction factor from a correction factor table in which a value of the correction factor is assigned respectively to pairs of values representing the target distance R and the inclination angle.

15. The device according to claim 12, wherein the microprocessor is configured so that a value of a correction factor to a pair of values representing a value of the target distance R and the inclination angle is calculated by means of an interpolation from correction factors stored in a correction factor table.

16. The device according to claim 13, wherein a correction factor table is stored in the memory to determine values of the correction factor by means of a ballistics program from data pertaining to an ammunition type and a mean value derived from values of correction factors for different types of ammunition.

17. The device according to claim 12, wherein the distance meter comprises a laser distance meter.

18. A riflescope with a device according to claim 12, wherein a display of the device showing a value of the replacement distance is visible in an aiming display of the rifle scope.

19. The riflescope according to claim 18, wherein the display is integrated in the optical path of the rifle scope.

20. A riflescope in which the device according to claim 12 is integrated in the riflescope.

21. A method for determining a replacement distance between a location and a point of impact of a projectile in a horizontal plane with a weapon and a sight mounted on the weapon, whereby a relative position of a line of sight through the visual optical path of the sighting telescope relative to a barrel axis of the weapon for a pre-definable projectile is zeroed in onto a pre-definable zeroing range between the location and the point of impact of the projectile in the horizontal plane, after which the determined relative position between the line of sight and the barrel axis is detected, wherein a target distance R between the location and a target disposed on the line of sight is determined and an inclination angle subtended by the line of sight and the horizontal plane is determined, and wherein a correction function is determined from the target distance R and the inclination angle, wherein the correction function is not dependent on the ballistic coefficient and the muzzle velocity of the used ammunition, and hence the target distance R is changed by applying the correction function to it in order to fix the replacement distance in the horizontal plane, and the relative position between the line of sight and the barrel axis is adjusted by the difference from the previously determined target distance R and re-set to the determined replacement distance.

22. The method according to claim 21, wherein the relative position between the line of sight and the barrel axis is changed by making an adjustment to the elevation turret of the sight.

23. The method according to claim 22, wherein the adjustment is made to the elevation turret of the sight electromechanically.

24. The method according to claim 22, wherein the adjustment is made to the sight automatically.

25. The method according to claim 21, wherein the relative position between the line of sight and the barrel axis is changed by taking aim with a secondary aiming mark of the sight corresponding to the determined replacement distance.

26. The method according to claim 21, wherein the relative position between the line of sight and the barrel axis is changed by optoelectronically adjusting an aiming mark of the sight in accordance with the determined replacement distance.

* * * * *